US008894817B1

(12) United States Patent
Cheng et al.

(10) Patent No.: US 8,894,817 B1
(45) Date of Patent: Nov. 25, 2014

(54) WET END CHEMICALS FOR DRY END STRENGTH

(71) Applicant: Ecolab USA Inc., St. Paul, MN (US)

(72) Inventors: Weiguo Cheng, Naperville, IL (US); Mei Liu, Plainfield, IL (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/157,437

(22) Filed: Jan. 16, 2014

(51) Int. Cl.
*D21H 17/37* (2006.01)
*D21H 17/28* (2006.01)
*D21H 23/14* (2006.01)

(52) U.S. Cl.
CPC ..... *D21H 17/375* (2013.01); *D21H 23/14* (2013.01); *D21H 17/28* (2013.01)
USPC ..... 162/168.3; 162/164.1; 162/164.6; 162/166; 162/175; 162/183

(58) Field of Classification Search
CPC ..... D21H 17/375; D21H 21/20; D21H 17/56; D21H 17/07; D21H 17/47; D21H 17/55; D21H 17/28; D21H 17/29; D21H 17/54; D21H 23/04; D21H 21/18; D21H 23/02; D21H 23/14; D21H 23/18; Y10S 8/17; Y10S 8/918
USPC ..... 162/158, 164.1, 164.6, 166, 162/168.1–168.3, 181.1, 183, 175
See application file for complete search history.

(56) References Cited

U.S. PATENT DOCUMENTS

| | | | | |
|---|---|---|---|---|
| 3,556,932 | A * | 1/1971 | Coscia et al. | 162/166 |
| 5,938,937 | A | 8/1999 | Sparapany et al. | |
| 6,315,866 | B1 * | 11/2001 | Sanchez | 162/168.2 |
| 6,592,718 | B1 * | 7/2003 | Wong Shing et al. | 162/164.1 |
| 6,939,443 | B2 | 9/2005 | Ryan et al. | |
| 7,125,469 | B2 | 10/2006 | Barcus et al. | |
| 7,323,510 | B2 | 1/2008 | Fischer et al. | |
| 7,615,135 | B2 | 11/2009 | Harrington et al. | |
| 7,740,743 | B2 | 6/2010 | Singh et al. | |
| 7,897,013 | B2 * | 3/2011 | Hagiopol et al. | 162/166 |
| 8,070,914 | B2 * | 12/2011 | Ryan et al. | 162/164.1 |
| 8,288,502 | B2 * | 10/2012 | Bode et al. | 528/246 |
| 8,349,134 | B2 * | 1/2013 | Esser et al. | 162/168.2 |
| 8,404,083 | B2 * | 3/2013 | Haehnle et al. | 162/164.6 |
| 8,425,724 | B2 * | 4/2013 | Ryan et al. | 162/164.1 |
| 8,454,798 | B2 | 6/2013 | Ban et al. | |
| 8,465,623 | B2 | 6/2013 | Zhao et al. | |
| 8,709,208 | B2 * | 4/2014 | Zhao et al. | 162/164.5 |
| RE44,936 | E * | 6/2014 | St. John et al. | 162/166 |
| 8,753,480 | B2 * | 6/2014 | Bode et al. | 162/168.3 |
| 2004/0060677 | A1 | 4/2004 | Huang | |
| 2008/0196851 | A1 | 8/2008 | Hund et al. | |
| 2009/0165978 | A1 * | 7/2009 | Hagiopol et al. | 162/168.3 |
| 2011/0132559 | A1 * | 6/2011 | Haehnle et al. | 162/164.6 |
| 2011/0146925 | A1 * | 6/2011 | Bode et al. | 162/164.1 |
| 2011/0155339 | A1 | 6/2011 | Brungardt et al. | |
| 2012/0073773 | A1 | 3/2012 | Jehn-Rendu et al. | |
| 2012/0186764 | A1 | 7/2012 | Mckay | |
| 2013/0081771 | A1 * | 4/2013 | Luo et al. | 162/164.6 |
| 2013/0133847 | A1 * | 5/2013 | Zhao et al. | 162/141 |
| 2013/0160959 | A1 * | 6/2013 | Rosencrance et al. | 162/164.6 |
| 2014/0053996 | A1 * | 2/2014 | Esser et al. | 162/164.3 |
| 2014/0060763 | A1 * | 3/2014 | Bode et al. | 162/164.6 |

FOREIGN PATENT DOCUMENTS

| | | | |
|---|---|---|---|
| EP | 1579071 | B1 | 7/2008 |
| WO | WO 2008028865 | A2 * | 3/2008 |

OTHER PUBLICATIONS

Castro et al., Use of Nanocrystaline Cellulose and Polymer Grafted Nanocrystaline Cellulose for Increasing Retention in Papermaking Process, U.S. Appl. No. 13/962,556, filed Aug. 8, 2013.

* cited by examiner

*Primary Examiner* — Jose Fortuna
(74) *Attorney, Agent, or Firm* — Benjamin E. Carlsen

(57) ABSTRACT

The invention provides methods and compositions for increasing the dry strength of paper. The invention utilizes a tailored strength agent whose size and shape is tailored to fit into the junction points between flocs of a paper sheet. The strength agents is in contact with the slurry for just enough time to collect at the junction points but not so much that it can migrate away from there.

10 Claims, 5 Drawing Sheets

WET END CHEMICALS FOR DRY END STRENGTH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to compositions, methods, and apparatuses for improving dry strength in paper using a process of treating a pulp slurry with a combination of strength agents.

As described for example in U.S. Pat. Nos. 8,465,623, 7,125,469, 7,615,135 and 7,641,776 and U.S. patent application Ser. No. 13/962,556, a number of materials function as effective wet-end dry strength agents. These agents can be added to the slurry to increase the tensile strength properties of the resulting sheet. As with retention aids however they must both allow for the free drainage of water from the slurry and also must not interfere with or otherwise degrade the effectiveness of other additives present in the resulting paper product.

Maintaining high levels of dry strength is a critical parameter for many papermakers. Obtaining high levels of dry strength may allow a papermaker to make high performance grades of paper where greater dry strength is required, use less or lower grade pulp furnish to achieve a given strength objective, increase productivity by reducing breaks on the machine, or refine less and thereby reduce energy costs. The productivity of a paper machine is frequently determined by the rate of water drainage from a slurry of paper fiber on a forming wire. Thus, chemistry that gives high levels of dry strength while increasing drainage on the machine is highly desirable.

As described for example in U.S. Pat. Nos. 7,740,743, 3,555,932, 8,454,798, and US Published Patent Applications 2012/0186764, 2012/0073773, 2008/0196851, 2004/0060677, and 2011/0155339, a number of compositions such as glyoxalated acrylamide-containing polymers are known to give excellent dry strength when added to a pulp slurry. U.S. Pat. No. 5,938,937 teaches that an aqueous dispersion of a cationic amide-containing polymer can be made wherein the dispersion has a high inorganic salt content. U.S. Pat. No. 7,323,510 teaches that an aqueous dispersion of a cationic amide-containing polymer can be made wherein the dispersion has a low inorganic salt content. European Patent No. 1,579,071 B1 teaches that adding both a vinylamine-containing polymer and a glyoxalated polyacrylamide polymer gives a marked dry strength increase to a paper product, while increasing the drainage performance of the paper machine. This method also significantly enhances the permanent wet strength of a paper product produced thereby. Many cationic additives, but especially vinylamine-containing polymers, are known to negatively affect the performance of optical brightening agents (OBA). This may prevent the application of this method into grades of paper containing OBA. U.S. Pat. No. 6,939,443, teaches that the use of combinations of polyamide-epichlorohydrin (PAE) resins with anionic polyacrylamide additives with specific charge densities and molecular weights can enhance the dry strength of a paper product. However, these combinations require the use of more than optimal amounts of additives and are sometimes practiced under difficult or cumbersome circumstances. As a result there is clear utility in novel methods for increasing the dry strength of paper.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

To satisfy the long-felt but unsolved needs identified above, at least one embodiment of the invention is directed towards a method of increasing the dry strength of a paper substrate. The method comprises the step of adding a GPAM copolymer to a paper substrate, wherein the addition occurs in the wet-end of a papermaking process after the substrate has passed through a screen but no more than 10 seconds before the substrate enters a headbox, the GPAM copolymer is constructed out of AcAm-AA copolymer intermediates having an average molecular weight of 5-15 kD, and the GPAM copolymer has an average molecular weight of 0.2-4 MD.

The GPAM may be added subsequent to the addition of an RDF to the paper substrate. The average molecular weight of intermediate for GPAM may be between 5 to 10 kD. The average molecular weight of intermediate for GPAM may be between 6 to 8 kD. The intermediates may have an m-value (FIG. 4) of between 0.03 to 0.20.

The paper substrate may undergo flocculation prior to the GPAM addition which results in the formation of flocs contacting each other at junction points and defining interface regions between the flocs. A majority of the GPAM added may be positioned at junction points and as low as 0% of the GPAM is located within the central 80% of the volume of each formed floc. Essentially no GPAM may be located within the central 80% of the volume of each formed floc.

The paper substrate may comprises filler particles. The paper substrate may have a greater dry strength than a similarly treated paper substrate in which the GPAM was in contact for more than 10 seconds. The paper substrate may have a greater dry strength than a similarly treated paper substrate in which the GPAM was manufactured out of intermediates of greater molecular weight. The paper substrate may have a greater dry strength than a similarly treated paper substrate in which the GPAM had a greater molecular weight.

At least one embodiment of the invention is directed towards a method of increasing the dry strength of a paper substrate. The method comprises the step of adding a strength agent to a paper substrate, wherein: said addition occurs in the wet-end of a papermaking process after the substrate has passed through a screen but no more than 10 seconds before the substrate enters a headbox.

At least one embodiment of the invention is directed towards a method of increasing the dry strength of a paper substrate. The method comprises the step of adding a GPAM copolymer to a paper substrate, wherein: the GPAM copolymer is constructed out of AcAm-AA copolymer intermediates having an average molecular weight of 6-8 kD, the GPAM copolymer has an average molecular weight of 0.2-4 MD.

Additional features and advantages are described herein, and will be apparent from, the following Detailed Description.

BRIEF DESCRIPTION OF THE DRAWINGS

A detailed description of the invention is hereafter described with specific reference being made to the drawings in which.

For the purposes of this disclosure, like reference numerals in the figures shall refer to like features unless otherwise indicated. The drawings are only an exemplification of the principles of the invention and are not intended to limit the invention to the particular embodiments illustrated.

DETAILED DESCRIPTION OF THE INVENTION

Figure 1:
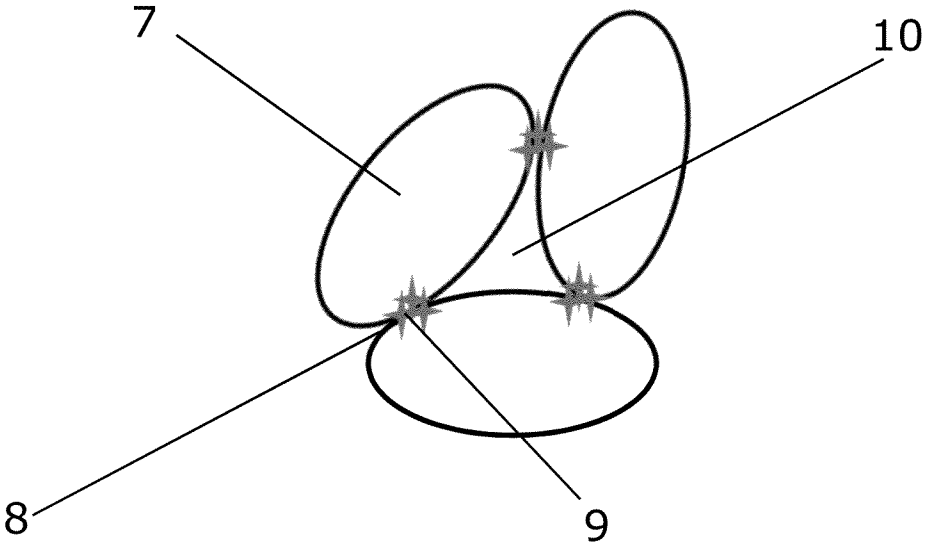
FIG. 1 is an illustration of the distribution of strength agent particles in paper flocs according to the invention.

The following definitions are provided to determine how terms used in this application, and in particular how the claims, are to be construed. The organization of the definitions is for convenience only and is not intended to limit any of the definitions to any particular category.

"AA" means acrylic acid.

"AcAm" means acrylamide.

"Wet End" means that portion of the papermaking process prior to a press section where a liquid medium such as water typically comprises more than 45% of the mass of the substrate, additives added in a wet end typically penetrate and distribute within the slurry.

"Dry End" means that portion of the papermaking process including and subsequent to a press section where a liquid medium such as water typically comprises less than 45% of the mass of the substrate, dry end includes but is not limited to the size press portion of a papermaking process, additives added in a dry end typically remain in a distinct coating layer outside of the slurry.

"Surface Strength" means the tendency of a paper substrate to resist damage due to abrasive force.

"Dry Strength" means the tendency of a paper substrate to resist damage due to shear force(s), it includes but is not limited to surface strength.

"Wet Strength" means the tendency of a paper substrate to resist damage due to shear force(s) when rewet.

"Wet Web Strength" means the tendency of a paper substrate to resist shear force(s) while the substrate is still wet.

"Substrate" means a mass containing paper fibers going through or having gone through a papermaking process, substrates include wet web, paper mat, slurry, paper sheet, and paper products.

"Paper Product" means the end product of a papermaking process it includes but is not limited to writing paper, printer paper, tissue paper, cardboard, paperboard, and packaging paper.

"Coagulant" means a water treatment chemical often used in solid-liquid separation stage to neutralize charges of suspended solids/particles so that they can agglomerate, coagulants are often categorized as inorganic coagulants, organic coagulants, and blends of inorganic and organic coagulants, inorganic coagulants often include or comprise aluminum or iron salts, such as aluminum sulfate/chloride, ferric chloride/sulfate, polyaluminum chloride, and/or aluminum chloride hydrate, organic coagulants are often positively charged polymeric compounds with low molecular weight, including but not limited to polyamines, polyquaternaries, polyDADMAC, Epi-DMA, coagulants often have a higher charge density and lower molecular weight than a flocculant, often when coagulants are added to a liquid containing finely divided suspended particles, it destabilizes and aggregates the solids through the mechanism of ionic charge neutralization, additional properties and examples of coagulants are recited in *Kirk-Othmer Encyclopedia of Chemical Technology,* 5th Edition, (2005), (Published by Wiley, John & Sons, Inc.).

"Colloid" or "Colloidal System" means a substance containing ultra-small particles substantially evenly dispersed throughout another substance, the colloid consists of two separate phases: a dispersed phase (or internal phase) and a continuous phase (or dispersion medium) within which the dispersed phase particles are dispersed, the dispersed phase particles may be solid, liquid, or gas, the dispersed-phase particles have a diameter of between approximately 1 and 1,000,000 nanometers, the dispersed-phase particles or droplets are affected largely by the surface chemistry present in the colloid.

"Colloidal Silica" means a colloid in which the primary dispersed-phase particles comprise silicon containing molecules, this definition includes the full teachings of the reference book: *The Chemistry of Silica: Solubility, Polymerization, Colloid and Surface Properties and Biochemistry of Silica*, by Ralph K. Iler, John Wiley and Sons, Inc., (1979) generally and also in particular pages 312-599, in general when the particles have a diameter of above 100 nm they are referred to as sols, aquasols, or nanoparticles.

"Colloidal Stability" means the tendency of the components of the colloid to remain in colloidal state and to not either cross-link, divide into gravitationally separate phases, and/or otherwise fail to maintain a colloidal state its exact metes and bounds and protocols for measuring it are elucidated in *The Chemistry of Silica: Solubility, Polymerization, Colloid and Surface Properties and Biochemistry of Silica*, by Ralph K. Iler, John Wiley and Sons, Inc., (1979).

"Consisting Essentially of" means that the methods and compositions may include additional steps, components, ingredients or the like, but only if the additional steps, components and/or ingredients do not materially alter the basic and novel characteristics of the claimed methods and compositions.

"DADMAC" means monomeric units of diallyldimethylammonium chloride, DADMAC can be present in a homopolymer or in a copolymer comprising other monomeric units.

"Droplet" means a mass of dispersed phase matter surrounded by continuous phase liquid, it may be suspended solid or a dispersed liquid.

"Effective amount" means a dosage of any additive that affords an increase in one of the three quantiles when compared to an undosed control sample.

"Flocculant" means a composition of matter which when added to a liquid carrier phase within which certain particles are thermodynamically inclined to disperse, induces agglomerations of those particles to form as a result of weak physical forces such as surface tension and adsorption, flocculation often involves the formation of discrete globules of particles aggregated together with films of liquid carrier interposed between the aggregated globules, as used herein flocculation includes those descriptions recited in ASTME 20-85 as well as those recited in Kirk-Othmer Encyclopedia of Chemical Technology, 5th Edition, (2005), (Published by Wiley, John & Sons, Inc.), flocculants often have a low charge density and a high molecular weight (in excess of 1,000,000) which when added to a liquid containing finely divided suspended particles, destabilizes and aggregates the solids through the mechanism of interparticle bridging.

"Flocculating Agent" means a composition of matter which when added to a liquid destabilizes, and aggregates colloidal and finely divided suspended particles in the liquid, flocculants and coagulants can be flocculating agents.

"GCC" means ground calcium carbonate filler particles, which are manufactured by grinding naturally occurring calcium carbonate bearing rock.

"GPAM" means glyoxalated polyacrylamide, which is a polymer made from polymerized acrylamide monomers (which may or may not be a copolymer comprising one or more other monomers as well) and in which acrylamide polymeric units have been reacted with glyoxal groups, representative examples of GPAM are described in US Published Patent Application 2009/0165978.

"Interface" means the surface forming a boundary between two or more phases of a liquid system.

"Papermaking process" means any portion of a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art. The papermaking process may also include a pulping stage, i.e. making pulp from a lignocellulosic raw material and bleaching stage, i.e. chemical treatment of the pulp for brightness improvement, papermaking is further described in the reference *Handbook for Pulp and Paper Technologists, 3rd Edition*, by Gary A. Smook, Angus Wilde Publications Inc., (2002) and *The Nalco Water Handbook* (3rd Edition), by Daniel Flynn, McGraw Hill (2009) in general and in particular pp. 32.1-32.44.

"Microparticle" means a dispersed-phase particle of a colloidal system, generally microparticle refers to particles that have a diameter of between 1 nm and 100 nm which are too small to see by the naked eye because they are smaller than the wavelength of visible light.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

At least one embodiment of the invention is directed towards a method of increasing the dry strength of a paper substrate by adding a glyoxylated polyacrylamide-acrylic acid copolymer (AGPAM) to a slurry after a retention drainage and formation (RDF) chemical has been added, after the slurry has been passed through a screen, prior to the slurry passing into a headbox wherein the slurry enters the headbox less than 10 seconds after it contacts the AGPAM and the AGPAM is formed from an intermediate whose molecular weight is less than 15 kD. This process results in exceptionally high dry strength properties.

The invention results in superior performance by doing the exact opposite of what the prior art teaches are best practices. As described for example in WO 2008/028865 (p. 6) GPAM intermediate copolymers are expected to require an average molecular weight of at least 25 kD preferably at least 30 kD and the larger size of the intermediates, the better the expected results. For example US Published Application 2012/0186764 (¶ [0021]) states " . . . the dry strength of the final polymer is theoretically maximized with the highest possible molecular weight of [intermediate] prepolymer . . . ". This teaches that although there is a maximum desired value for size of intermediates, until this maximum is reached, smaller intermediates should perform less well than larger intermediates. In contrast the invention utilizes a specially sized polymer constructed within a very narrow process window whose intermediates are far smaller than the maximum so should not work well but in fact work better than the prior art says they should.

Figure 2:
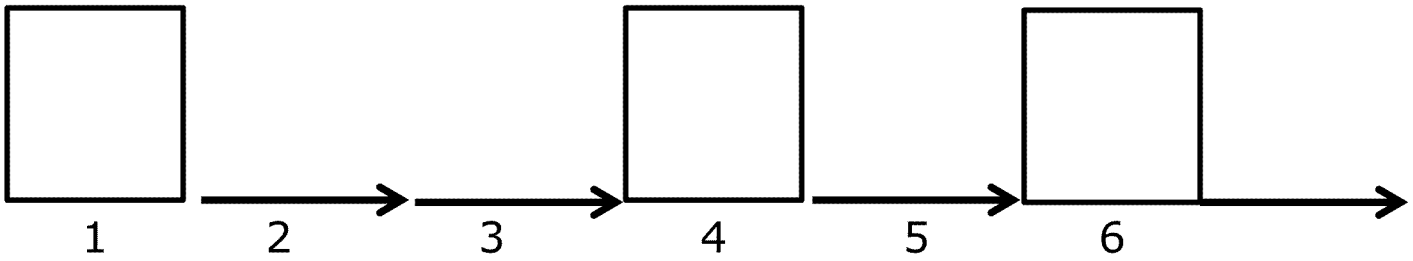
FIG. 2 is an illustration of one possible example of a papermaking process involved in the invention.

Similarly the invention uses a very brief residence time while the prior art teaches that one should maximize residence time as much as possible. As can be seen in FIG. 2 in one example of at least a portion of a wet-end of a papermaking process thick stock of pulp (1) is diluted (often with white water) to form thin stock (2). Flocculant is added to the thin stock (3) which then passes through a screen (4), has an RDF (5) added (such as a microparticle/silica material), enters a headbox (6), then passes on to the subsequent portions of the papermaking process such as a Fourdrinier wire/table. The prior art teaches that the longer the contact time between the strength agent and the substrate, more interactions occur and therefore it would be most effective to maximize this contact. As a result strength agents are typically added right at the beginning to the thick stock (1). In contrast in the invention the modified GPAM is added at the last possible moment with only seconds to interact.

Figure 3:
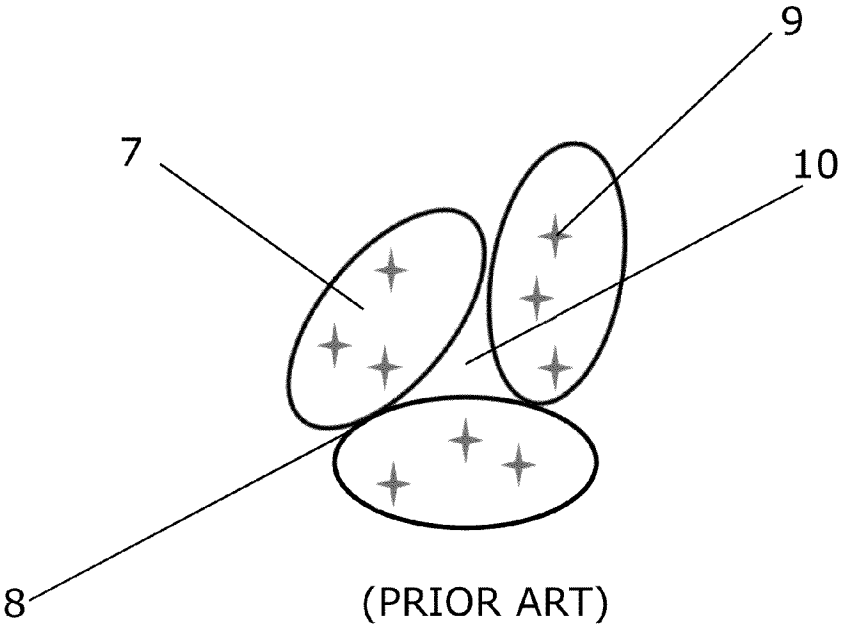
(PRIOR ART) FIG. 3
FIG. 3 is an illustration of the distribution of strength agent particles in paper flocs according to the prior art.

Without being limited by a particular theory or design of the invention or of the scope afforded in construing the claims, it is believed that the modified GPAM and the brief residence time allow for a highly targeted application of GPAM which yields a highly unexpected result. As illustrated in FIG. 3, after flocculation the paper substrate consists of flocs (7), (aggregated masses of slurry fibers). These aggregated masses themselves have narrow junction points (8) where they contact each other. Over the prolonged residence time the strength agents (9) tend to disperse widely throughout the flocs. The result is that the flocs themselves have strong integrity but the junction points between the flocs are a weak point between them because they are adjacent to unconnected void regions (10), which define the interface region. As illustrated in FIG. 1, by using a modified GPAM copolymer for the brief residence time the combination of the specific size/shape and the time of contact results in the strength agent not having the time to disperse within the flocs (7) and instead concentrating predominantly at the junction points (8). Because the junction points are the weakest structural point in the floc, this concentration results in a large increase in dry strength properties.

Figure 4:
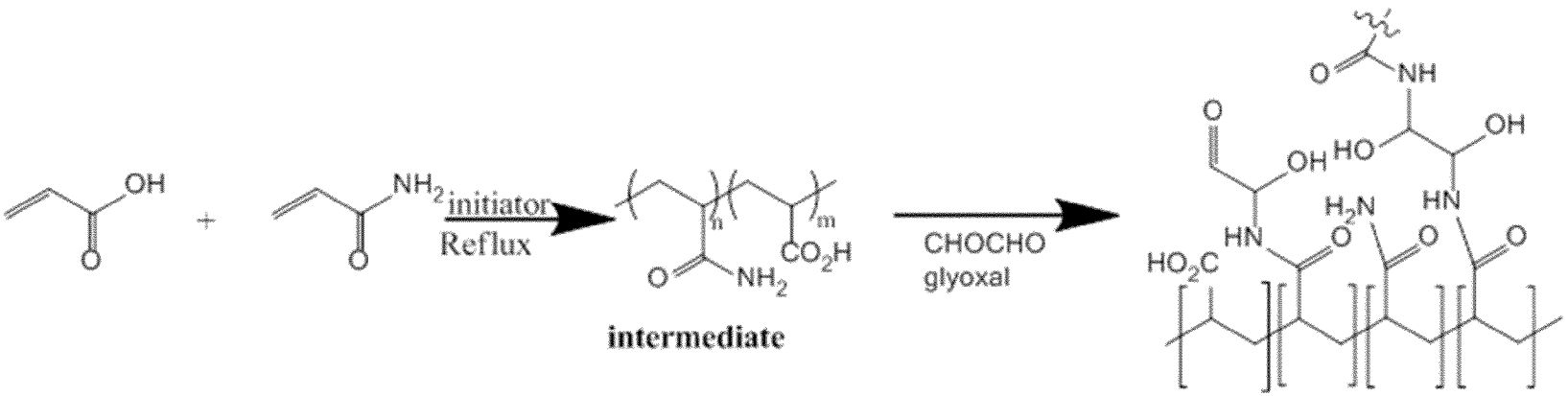
FIG. 4 is an illustration of a method of manufacturing a modified GPAM copolymer.

In at least one embodiment the modified GPAM is constructed according to a narrow production window. As illustrated in FIG. 4 AA and AcAm monomers are polymerized to form a copolymer intermediate. The intermediate is then reacted with glyoxal to form the modified GPAM strength agent.

Figure 5:
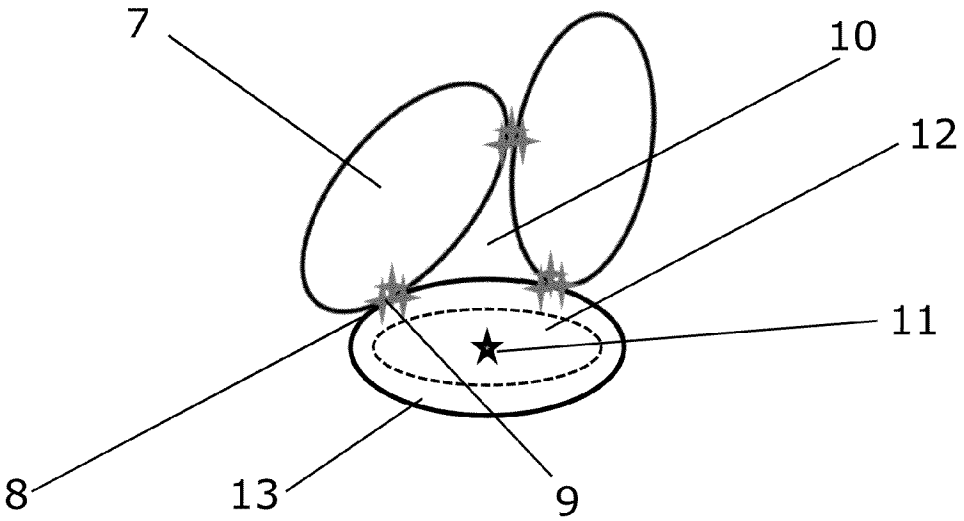
FIG. 5 is an illustration of the distribution of strength agent particles in a single paper floc according to the invention.

An illustration of possible distribution of GPAM in a floc (7) is shown in FIG. 5. The floc is an irregular shaped mass which has a distinct central point (11). "Central point" is a broad term which encompass one, some, or all of the center of mass, center of volume, and/or center of gravity of the floc. The central volume (12) is a volume subset of the floc which encompasses the central point (11) and has the minimum distance possible between the central point and all points along the boundary of the central volume (12).

It is understood that because both the floc and the medium they are in are aqueous, over time the GPAM will distribute substantially uniformly. As a result limitations in residence time will result in decreases in distribution of the GPAM to the central volume relative to the outer volume (13) (the volume of the floc outside the central volume) and the interface region. The interface region includes the junction points. In at least one embodiment between >50% to 100% of the added GPAM is located in the interface region. In at least one embodiment between >50% to 100% of the added GPAM is located in the interface region and in the outer volume. In at least one embodiment the central region comprises between 1% and 99% of the overall volume of the floc.

In addition it should be understood that even a marginal alteration of the GPAM distribution from the central volume and/or from the outer volume to the interface region and to the junction points will result in an increase in strength. An alteration in distribution even as low as 1% or lower can be expected to increase the strength effects of the GPAM.

The ratio of AA to AcAm monomers in the intermediate copolymer can be expressed as m-value+n-value=1 where m-value is the relative amount of polymer structural units formed from AA monomers and n-value is the relative amount of polymer structural units formed AcAm monomers.

Copolymer intermediates having specific structural geometry and specific sizes can be formed by limiting the m-value. In at least one embodiment the m-value is between 0.03 to 0.07 and the resulting copolymer intermediate has a size of 7-9 kD. Because the relative amounts of AcAm provides the binding sites for reaction with glyoxal, the number and proximity of the AcAm units will determine the unique structural geometry that the resulting GPAM will have. Steric factors will also limit how many and which of the AcAm units will not react with glyoxal.

In at least one embodiment the final GPAM product carries four functional groups, Acrylic acid, Acrylamide, mono-reacted acrylamide (one glyoxal reacts with one acrylamide) and di-reacted acrylamide (one glyoxal reacts with two acrylamide). Conversion of glyoxal means how much added glyoxal reacted (both mono or di) with acrylamide. Di-reacted acrylamide creates crosslinking and increases molecular weight of the final product.

In at least one embodiment the final GPAM product has an average molecular weight of around 1 mD. The unique structure of a ~1 mD GPAM constructed out of cross-linked 7-9 kD intermediates for the limited residence time allows for greater dry strength than for the same or greater residence times of: a) a 1 mD GPAM made from larger sized intermediates, b) a 1 mD GPAM made from smaller sized intermediates, and c) a 2-10 mD GPAM.

In at least one embodiment the modified GPAM is added after an RDF has been added to the substrate. RDF functions to retain desired materials in the dry-end rather than having them removed along with water being drained away from the substrate As a result GPAM is predominantly located at the junction points of fiber flocs.

In at least one embodiment a cationic aqueous dispersion-polymer is also added to the substrate, this addition occurring prior to, simultaneous to, and/or after the addition of the GPAM to the substrate.

In at least one embodiment the degree of total glyoxal functionalization ranges of from 30% to 70%.

In at least one embodiment the intermediate is formed from one or more additional monomers selected form the list consisting of cationic comonomers including, but are not limited to, diallyldimethylammonium chloride (DADMAC), 2-(dimethylamino)ethyl acrylate, 2-(dimethylamino)ethyl methacrylate, 2-(diethylaminoethyl) acrylate, 2-(diethylamino) ethyl methacrylate, 3-(dimethylamino)propyl acrylate, 3-(dimethylamino)propyl methacrylate, 3-(diethylamino) propyl acrylate, 3-(diethylamino)propyl methacrylate, N-[3-(dimethylamino)propyl]acrylamide, N-[3-(dimethylamino) propyl]methacrylamide, N-[3-(diethylamino)propyl] acrylamide, N-[3-(diethylamino)propyl]methacrylamide, [2-(acryloyloxy)ethyl]trimethylammonium chloride, [2-(methacryloyloxy)ethyl]trimethylammonium chloride, [3-(acryloyloxy)propyl]trimethylammonium chloride, [3-(methacryloyloxy)propyl]trimethylammonium chloride, 3-(acrylamidopropyl)trimethylammonium chloride (APTAC), and 3-(methacrylamidopropyl)trimethylammonium chloride (MAPTAC). The preferred cationic monomers are DADMAC, APTAC, and MAPTAC.

In at least one embodiment the cationic aqueous dispersion polymers useful in the present invention are one or more of those described in U.S. Pat. No. 7,323,510. As disclosed therein, a polymer of that type is composed generally of two different polymers: (1) A highly cationic dispersant polymer of a relatively lower molecular weight ("dispersant polymer"), and (2) a less cationic polymer of a relatively higher molecular weight that forms a discrete particle phase when synthesized under particular conditions ("discrete phase"). This invention teaches that the dispersion has a low inorganic salt content.

In at least one embodiment this invention can be applied to any of the various grades of paper that benefit from enhanced dry strength including but not limited to linerboard, bag, boxboard, copy paper, container board, corrugating medium, file folder, newsprint, paper board, packaging board, printing and writing, tissue, towel, and publication. These paper grades can be comprised of any typical pulp fibers including groundwood, bleached or unbleached Kraft, sulfate, semi-mechanical, mechanical, semi-chemical, and recycled.

In at least one embodiment the paper substrate comprises filler particles such as PCC, GCC, and preflocculated filler materials. In at least one embodiment the filler particles are added according to the methods and/or with the compositions described in U.S. patent application Ser. Nos. 11/854,044, 12/727,299, and/or 13/919,167.

EXAMPLES

The foregoing may be better understood by reference to the following examples, which are presented for purposes of illustration and are not intended to limit the scope of the invention. In particular the examples demonstrate representative examples of principles innate to the invention and these principles are not strictly limited to the specific condition recited in these examples. As a result it should be understood that the invention encompasses various changes and modifications to the examples described herein and such changes and modifications can be made without departing from the spirit and scope of the invention and without diminishing its intended advantages. It is therefore intended that such changes and modifications be covered by the appended claims.

The purpose of example 1 and 2 is to demonstrate the effect of addition points of dry strength agent on sheet strength properties.

Example 1

The furnish used consisted of 24% PCC, 19% softwood and 57% hardwood. PCC is Albacar HO, obtained from Specialty Mineral Inc. (SMI) Bethlehem, Pa. USA. Both softwood and hardwood are made from dry laps and refined to 400 CSF freeness.

Handsheets are prepared by mixing 570 mL of 0.6% consistency furnish at 1200 rpm in a Dynamic Drainage Jar with the bottom screen covered by a solid sheet of plastic to prevent drainage. The Dynamic Drainage Jar and mixer are available from Paper Chemistry Consulting Laboratory, Inc., Carmel, N.Y. Mixing is started and 18 lb/ton cationic starch Stalok 300 is added after 15 seconds, followed by 0, 2 or 4 lb/ton dry strength agent at 30 seconds, and lb/ton (product based) cationic flocculant N-61067 available from Nalco Company, Naperville, Ill. USA) at 45 seconds, followed by 1 lb/ton active microparticle N-8699 available from Nalco Company, Naperville, Ill. USA at 60 seconds.

Mixing is stopped at 75 seconds and the furnish is transferred into the deckle box of a Noble & Wood handsheet mold. The 8"×8" handsheet is formed by drainage through a 100 mesh forming wire. The handsheet is couched from the sheet mold wire by placing two blotters and a metal plate on the wet handsheet and roll-pressing with six passes of a 25 lb metal roller. The forming wire and one blotter are removed and the handsheet is placed between two new blotters and a metal plate. Then the sheet was pressed at 5.65 MPa under a static press for five minutes. All of the blotters are removed and the handsheet is dried for 60 seconds (metal plate side facing the dryer surface) using a rotary drum drier set at 220° F. The average basis weight of a handsheet is 80 g/m$^2$. The handsheet mold, static press, and rotary drum dryer are available from Adirondack Machine Company, Queensbury, N.Y. Five replicate handsheets are produced for each condition.

The finished handsheets are stored overnight at TAPPI standard conditions of 50% relative humidity and 23° C. The basis weight (TAPPI Test Method T 410 om-98), ash content (TAPPI Test Method T 211 om-93) for determination of filler content, and formation, a measure of basis weight uniformity, is determined using a Kajaani® Formation Analyzer from Metso Automation, Helsinki, FI. Basis weight, ash content and Kajaani formation data was listed in Table I. Tensile strength (TAPPI Test Method T 494 om-01) and z-directional tensile strength (ZDT, TAPPI Test Method T 541 om-89) of the handsheets are also tested and listed in Table II. Strength data is strongly dependent on filler content in the sheet. For comparison purpose, all the strength data was also calculated at 20% ash content assuming sheet strength decreases linearly with filler content. The strength data at 20% ash content (AC) was also reported in Table II.

Example 2

Example 1 was repeated except that 2 or 4 lb/ton dry strength agent was added 15 seconds after the addition of flocculant N-61067. The handsheet testing results were also summarized in Table I and II.

As shown in Table I and II, addition of strength agent not only increased filler retention, but also increased sheet strength significantly. The effect was even bigger when the dry strength agent was added after flocculant.

Example 3

Example 1 was repeated except that the dry strength agent was prepared using different Mw intermediate according to the procedure described in Example A. The handsheet testing results of example 3 was listed in Table III and IV. The results showed intermediate molecular weight affected the performance of dry strength agent significantly. The optimal intermediate molecular weight of dry strength agent was between 6 to 8 thousand Daltons.

Example 4

Example 2 was repeated except that dry strength agent was prepared using different Mw intermediate according to the procedure described in Example A. The handsheet testing results of example 4 was listed in Table V and VI. The results showed intermediate molecular weight affected the performance of dry strength agent significantly. The optimal intermediate molecular weight of dry strength agent was between 6 to 8 thousand Daltons. Compared with Example 3, it showed that dry strength agent performed much better when it was added after flocculant. The combination of adding the strength agent after flocculant and choosing optimal intermediate molecular weight for the dry strength agent gave the highest dry strength improvement.

TABLE I

The effect of GPAM dry strength agent and its addition points on sheet properties

| | Dry Strengh | Dry Strength | Basis Weight (gsm) | | Ash Content (%) | | Ash Retention (%) | | Kajaani Formation | |
|---|---|---|---|---|---|---|---|---|---|---|
| Conditions | Addition Points | Dose (lb/ton) | Mean | σ | Mean | σ | Mean | σ | Mean | σ |
| Reference | None | 0.0 | 74.0 | 0.4 | 16.0 | 0.2 | 61.7 | 1.1 | 109.0 | 1.3 |
| Reference | None | 0.0 | 74.0 | 0.5 | 20.9 | 0.4 | 65.8 | 1.5 | 105.0 | 2.8 |
| Example 1-1 | Before Flocculant | 2.0 | 77.6 | 0.7 | 19.3 | 0.2 | 77.8 | 0.8 | 99.7 | 2.3 |
| Example 1-2 | Before Flocculant | 4.0 | 77.6 | 0.5 | 18.9 | 0.4 | 76.3 | 1.8 | 97.5 | 2.1 |
| Example 2-1 | After Flocculant | 2.0 | 78.5 | 0.6 | 19.5 | 0.4 | 79.9 | 2.1 | 101.5 | 3.7 |
| Example 2-2 | After Flocculant | 4.0 | 78.2 | 0.9 | 19.5 | 0.3 | 79.6 | 2.0 | 101.4 | 1.4 |

TABLE II

The effect of GPAM dry strength agent and its addition points on sheet strength properties

| | Dry Strengh | Dry Strength | ZDT (kPa) | | | Tensile Index (N.m/g) | | | TEA ($J/m^2$) | | |
|---|---|---|---|---|---|---|---|---|---|---|---|
| Conditions | Addition Points | Dose (lb/ton) | Mean | σ | 20% AC | Mean | σ | 20% AC | Mean | σ | 20% AC |
| Reference | None | 0.0 | 451.7 | 8.6 | 410.3 | 31.3 | 1.7 | 26.8 | 44.2 | 5.5 | 32.6 |
| Reference | None | 0.0 | 401.3 | 9.7 | 410.3 | 25.8 | 1.1 | 26.8 | 30.2 | 3.1 | 32.6 |
| Example 1-1 | Before Flocculant | 2.0 | 460.8 | 4.5 | 453.0 | 28.7 | 1.1 | 27.8 | 39.0 | 4.7 | 36.9 |
| Example 1-2 | Before Flocculant | 4.0 | 479.8 | 7.1 | 468.1 | 31.8 | 1.1 | 30.5 | 46.9 | 5.8 | 43.6 |
| Example 2-1 | After Flocculant | 2.0 | 468.3 | 13.2 | 463.5 | 31.2 | 1.3 | 30.7 | 46.6 | 5.1 | 45.2 |
| Example 2-2 | After Flocculant | 4.0 | 493.4 | 7.7 | 488.6 | 32.6 | 1.5 | 32.1 | 53.6 | 2.9 | 52.2 |

TABLE III

GPAM samples made out of intermediates with different molecular weight

| sample | Intermediate Mw, Dalton | unreacted glyoxal, % | mono-glyoxal, % | di-glyoxal % | *unreacted amide, % | *mono-amide, % | *di-amide, % | BFV before kill, cps | BFV cps | Final Mw kD |
|---|---|---|---|---|---|---|---|---|---|---|
| 6763-129 | 7,400 | 45 | 35 | 20 | 73 | 13 | 14 | 19 | 10.7 | 1,000 |
| 6889-31 | 9,000 | 53 | 31 | 16 | 76 | 12 | 12 | ~23 | 13 | 670 |
| 6889-38 | 5,700 | 46 | 25 | 29 | 70 | 9 | 21 | 11.8 | 6.5 | 2,700 |
| 6889-43 | 7,400 | 46 | 25 | 29 | 70 | 9 | 21 | 24 | 12.8 | 3,000 |

TABLE IV

The effect of the molecular weight of intermediate on the performance of GPAM as dry strength agent. GPAM was added before flocculant.

| Dry Strength | Dry Strength | Basis Weight (gsm) | | Ash Content (%) | | Ash Retention (%) | | Kajaani Formation | |
|---|---|---|---|---|---|---|---|---|---|
| Type | Dose (lb/ton) | Mean | σ | Mean | σ | Mean | σ | Mean | σ |
| Reference | 0.0 | 76.9 | 0.4 | 19.9 | 0.3 | 77.3 | 0.6 | 91.8 | 1.6 |
| Reference | 0.0 | 75.2 | 1.0 | 24.3 | 0.5 | 97.8 | 1.6 | 92.2 | 3.8 |
| 6763-129 | 2.0 | 78.4 | 0.9 | 21.0 | 0.3 | 82.9 | 2.0 | 81.7 | 3.1 |
| 6763-129 | 4.0 | 78.3 | 1.4 | 21.2 | 0.3 | 83.2 | 2.6 | 81.3 | 4.0 |
| 6889-31 | 2.0 | 78.5 | 0.7 | 21.0 | 0.3 | 82.4 | 1.5 | 80.3 | 5.4 |
| 6889-31 | 4.0 | 78.8 | 0.6 | 21.2 | 0.1 | 84.1 | 0.9 | 77.6 | 1.4 |
| 6889-38 | 2.0 | 77.9 | 0.7 | 20.5 | 0.2 | 79.4 | 0.9 | 84.7 | 1.3 |
| 6889-38 | 4.0 | 78.1 | 0.4 | 20.6 | 0.2 | 81.0 | 0.5 | 84.2 | 1.4 |
| 6889-43 | 2.0 | 77.9 | 0.9 | 20.5 | 0.3 | 79.9 | 1.3 | 83.5 | 2.6 |
| 6889-43 | 4.0 | 78.2 | 0.7 | 21.0 | 0.2 | 82.1 | 0.7 | 82.9 | 4.5 |

TABLE V

The effect of the molecular weight of intermediate on the performance of GPAM as dry strength agent. GPAM was added before flocculant.

| Dry Strength | Dry Strength | ZDT (kPa) | | | | Tensile Index (N.m/g) | | | TEA ($J/m^2$) | | |
|---|---|---|---|---|---|---|---|---|---|---|---|
| Type | Dose (lb/ton) | (kPa) | Mean | σ | 20% AC | Mean | σ | 20% AC | Mean | σ | 20% AC |
| Reference | 0.0 | 446.3 | 444.0 | 14.6 | 448.7 | 27.7 | 0.5 | 28.0 | 38.6 | 3.0 | 39.5 |
| Reference | 0.0 | 376.6 | 387.0 | 15.7 | 448.7 | 23.3 | 1.6 | 28.0 | 27.0 | 3.4 | 39.5 |
| 6763-129 | 2.0 | 444.0 | 444.3 | 15.9 | 456.7 | 27.2 | 1.1 | 28.1 | 37.2 | 3.6 | 39.8 |
| 6763-129 | 4.0 | 449.1 | 466.6 | 14.4 | 482.0 | 28.8 | 1.4 | 30.0 | 42.0 | 3.8 | 45.1 |
| 6889-31 | 2.0 | 413.5 | 437.4 | 16.8 | 450.0 | 26.6 | 1.0 | 27.5 | 31.8 | 3.8 | 34.4 |
| 6889-31 | 4.0 | 454.6 | 453.8 | 18.9 | 473.3 | 27.3 | 0.6 | 28.7 | 35.7 | 3.7 | 39.7 |
| 6889-38 | 2.0 | 450.5 | 452.2 | 7.4 | 463.8 | 27.2 | 0.7 | 28.1 | 36.3 | 3.1 | 38.6 |
| 6889-38 | 4.0 | 473.4 | 477.5 | 9.8 | 490.2 | 28.4 | 0.6 | 29.4 | 40.6 | 2.7 | 43.2 |
| 6889-43 | 2.0 | 450.4 | 459.8 | 14.1 | 474.0 | 28.2 | 1.5 | 29.3 | 39.4 | 4.7 | 42.3 |
| 6889-43 | 4.0 | 451.6 | 465.4 | 12.9 | 483.5 | 29.1 | 2.0 | 30.5 | 40.8 | 5.5 | 44.5 |

TABLE VI

The effect of the molecular weight of intermediate on the performance of GPAM as dry strength agent. GPAM was added after flocculant.

| Dry Strength | Dry Strength | Basis Weight (gsm) | | Ash Content (%) | | Ash Retention (%) | | Kajaani Formation | |
|---|---|---|---|---|---|---|---|---|---|
| Type | Dose (lb/ton) | Mean | σ | Mean | σ | Mean | σ | Mean | σ |
| Reference | 0.0 | 76.7 | 0.6 | 19.8 | 0.3 | 75.9 | 1.6 | 93.8 | 3.4 |
| Reference | 0.0 | 76.1 | 0.5 | 24.7 | 0.3 | 101.1 | 1.9 | 91.1 | 1.4 |
| 6763-129 | 2.0 | 77.9 | 0.5 | 21.2 | 0.2 | 82.7 | 0.8 | 91.5 | 2.9 |
| 6763-129 | 4.0 | 78.1 | 0.2 | 20.7 | 0.3 | 81.0 | 1.2 | 93.4 | 1.5 |
| 6889-31 | 2.0 | 77.6 | 0.4 | 21.2 | 0.2 | 82.3 | 0.4 | 91.3 | 2.9 |
| 6889-31 | 4.0 | 77.7 | 0.6 | 20.8 | 0.1 | 80.8 | 0.4 | 92.4 | 1.0 |
| 6889-38 | 2.0 | 77.3 | 0.3 | 20.8 | 0.2 | 80.5 | 1.0 | 94.2 | 4.0 |
| 6889-38 | 4.0 | 77.3 | 0.4 | 20.6 | 0.3 | 79.5 | 1.2 | 94.8 | 3.1 |
| 6889-43 | 2.0 | 78.4 | 0.8 | 21.0 | 0.3 | 82.3 | 0.7 | 92.0 | 3.4 |
| 6889-43 | 4.0 | 77.7 | 0.4 | 20.7 | 0.3 | 80.6 | 1.4 | 96.9 | 3.4 |

TABLE VII

The effect of the molecular weight of intermediate on the performance of GPAM as dry strength agent. GPAM was added after flocculant.

| Dry Strength | Dry Strength | ZDT (kPa) | | | Tensile Index (N.m/g) | | | TEA ($J/m^2$) | | |
|---|---|---|---|---|---|---|---|---|---|---|
| Type | Dose (lb/ton) | Mean | σ | 20% AC | Mean | σ | 20% AC | Mean | σ | 20% AC |
| Reference | 0.0 | 414.1 | 11.3 | 412.3 | 27.5 | 1.5 | 27.3 | 33.2 | 4.8 | 32.8 |
| Reference | 0.0 | 370.3 | 6.4 | 412.3 | 22.9 | 0.6 | 27.3 | 25.3 | 2.3 | 32.8 |
| 6763-129 | 2.0 | 462.4 | 12.4 | 473.4 | 29.1 | 0.4 | 30.2 | 41.2 | 3.6 | 43.2 |
| 6763-129 | 4.0 | 467.8 | 15.7 | 474.5 | 29.7 | 1.2 | 30.4 | 39.1 | 4.4 | 40.3 |
| 6889-31 | 2.0 | 448.1 | 13.4 | 458.9 | 28.6 | 0.6 | 29.7 | 39.3 | 1.7 | 41.3 |
| 6889-31 | 4.0 | 466.1 | 22.8 | 473.2 | 29.2 | 0.4 | 29.9 | 38.2 | 3.1 | 39.4 |
| 6889-38 | 2.0 | 468.9 | 13.1 | 476.2 | 29.5 | 0.9 | 30.3 | 40.5 | 2.7 | 41.9 |
| 6889-38 | 4.0 | 493.0 | 6.0 | 497.9 | 32.1 | 1.1 | 32.6 | 48.2 | 3.8 | 49.1 |
| 6889-43 | 2.0 | 463.6 | 6.7 | 472.6 | 29.1 | 1.2 | 30.0 | 40.2 | 3.8 | 41.8 |
| 6889-43 | 4.0 | 488.7 | 8.5 | 495.3 | 30.2 | 1.6 | 30.9 | 43.2 | 4.3 | 44.4 |

The data demonstrates that both using GPAM of an especially small size and/or limiting the residence time to extremely short periods of time results in unexpected increases in paper strength. For example when a large intermediate GPAM was used with a long residence time the resulting ZDT strength was 463.8 kPa. Under the same conditions a smaller intermediate GPAM resulted in ZDT of 483.5 kPa and a smaller intermediate GPAM with a short residence time resulted in ZDT of 495.3 kPa. Thus by doing the opposite of what the prior art teaches, greater strength can be achieved.

As previously stated, in at least one embodiment utilizing specially sized intermediates produced within in a very narrow process window results in better than expected results. Representative procedures used to produce/use those intermediates are shown in example A below.

Example A 6763-129

Representative procedure for the synthesis of polyacrylamide-acrylic acid copolymer Intermediate A: To a 1 L reaction flask equipped with a mechanical stirrer, thermocouple, condenser, nitrogen purge tube, and addition port was added 145.33 g of water. It was then purged with $N_2$ and heated to reflux. Upon reaching the desired temperature (~95-100° C.), 22.5 g of a 20% aqueous solution of ammonium persulfate (APS) and 55.36 g of a 25% aqueous solution of sodium meta-bisulfite (SMBS) were added to the mixture through separate ports over a period of 130 min. Two minutes after starting the initiator solution additions, a monomer mixture containing 741.60 g of 51.2% acrylamide, 20.29 g of acrylic acid, 11.42 g of water, 0.12 g of EDTA, and 3 g of 50% sodium hydroxide was added to the reaction mixture over a period of 115 minutes. The reaction was held at reflux for an additional hour after APS and SMBS additions. The mixture was then cooled to room temperature providing the intermediate product as a 40% actives, viscous and clear to amber solution. It had a molecular weight of about 7,400 g/mole.

Representative procedure for glyoxalation of polyacrylamide-acrylic acid: The intermediate product A (70.51 g) prepared above and water (369.6 g) were charged into a 500-mL tall beaker at room temperature. The pH of the polymer solution was adjusted to 8.8-9.2 using 1.4 g of 50% aqueous sodium hydroxide solution. The reaction temperature was set to 24-26° C. Glyoxal (21.77 g of a 40% aqueous solution) was added over 15-45 min, pH of the resulting solution was then adjusted to 9-9.5 using 10% sodium hydroxide solution (3.5 g). The brookfield viscosity (Brookfield Programmable DV-E Viscometer, #1 spindle 60 rpm, Brookfield Engineering Laboratories, Inc, Middleboro, Mass.) of the mixture was about 3-4 cps after sodium hydroxide addition. The pH of the reaction mixture was maintained at about 8.5 to 9.5 at about 24-26° C. with good mixing (more 10% sodium hydroxide solution can be added if necessary). The Brookfield viscosity (BFV) was measured and monitored every 15-45 minutes and upon achieving the desired viscosity increase of greater than or equal to 1 cps (4 to 200 cps, >100,000 g/mole) the pH of the reaction mixture was decreased to 2-3.5 by adding sulfuric acid (93%). The rate of viscosity increase was found to be dependent on the reaction pH. The higher the pH of the reaction, the faster the rate of viscosity increase. The product was a clear to hazy, colorless to amber, fluid with a BFV greater than or equal to 4 cps. The resulting product was more stable upon storage when BFV of the product was less than 40 cps, and when the product was diluted to lower actives. The product can be prepared at higher or lower percent total actives by adjusting the desired target product viscosity. For sample 6889-129, it has a BFV of 10.7 cps, active concentration of 7.69% (total glyoxal and polymer), and molecular weight of about 1 million g/mole.

6889-31

Intermediate B was synthesized following similar process as described for intermediate A except that a different chain transfer agent (sodium hypophosphite) was used. The final product has an active concentration of 36%. It is a viscous and clear to amber solution, and had a molecular weight of about 9,000 g/mole.

6889-31 was synthesized following similar process as described for 6763-129 except that intermediate B was used. The final product has a BFV of 13.2 cps, active concentration of 7.84% (total glyoxal and polymer), and molecular weight of about 670,000 g/mole.

6889-38

Intermediate C was synthesized following similar process as described for intermediate A except that sodium formate and sodium hypophosphite were used as the chain transfer agent. The final product has an active concentration of 36%. It is a viscous and clear to amber solution, and had a molecular weight of about 5,700 g/mole.

6889-38 was synthesized following similar process as described for 6763-129 except that intermediate C was used. The final product has a BFV of 6.5 cps, active concentration of 7.84% (total glyoxal and polymer), and molecular weight of about 2.7 million g/mole.

6889-43

Intermediate D was synthesized following similar process as described for intermediate A except that different chain transfer agent (sodium hypophosphite) was used. The final product has an active concentration of 36% actives. It is a viscous and clear to amber solution, and had a molecular weight of about 7,400 g/mole.

6889-43 was synthesized following similar process as described for 6763-129 except that intermediate D was used. The final product has a BFV of 12.8 cps, active concentration of 7.83% (total glyoxal and polymer), and molecular weight of about 3 million g/mole.

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments mentioned herein, described herein and/or incorporated herein. In addition the invention encompasses any possible combination that also specifically excludes any one or some of the various embodiments mentioned herein, described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of increasing the dry strength of a paper substrate, the method comprising adding a flocculant and starch to a paper substrate and then adding a glyoxalated polyacrylamide (GPAM) copolymer to the paper substrate, wherein:

said addition of GPAM occurs in the wet-end of a papermaking process after the substrate has passed through a screen but no more than 18 seconds before the substrate enters a headbox, the GPAM copolymer is constructed out of acrylamide-acrylic acid (AcAm-AA) copolymer intermediates having an average molecular weight of 5.7-9 kD, the GPAM copolymer has an average molecular weight of 0.6-3 MD.

2. The method of claim 1 in which the GPAM is added subsequent to the addition of a retention drainage and formation chemical (RDF) to the paper substrate.

3. The method of claim 1 in which the average molecular weight of intermediate for GPAM was between 6 to 8 kD.

4. The method of claim 1 in which the intermediates have an m-value of between 0.03 to 0.20.

5. The method of claim 1 in which the intermediates have an m-value of between 0.03 to 0.15.

6. The method of claim 5 in which a majority of the GPAM added is positioned at junction points and as low as 0% of the GPAM is located within the central 80% of the volume of each formed floc.

7. The method of claim 5 in which essentially no GPAM is located within the central 80% of the volume of each formed floc.

8. The method of claim 1 in which the paper substrate undergoes flocculation prior to the GPAM addition which result in the formation of flocs contacting each other at junction points.

9. The method of claim 1 in which the paper substrate comprises filler particles.

10. The method of claim 1 in which the paper substrate has a greater dry strength than a similarly treated paper substrate in which the GPAM was in contact for more than 18 seconds.

* * * * *